US007125000B1

(12) United States Patent
Saavedra et al.

(10) Patent No.: US 7,125,000 B1
(45) Date of Patent: Oct. 24, 2006

(54) POST PULLER

(76) Inventors: Daniel R. Saavedra, P.O. Box 423, Grapeland, TX (US) 75844-0423; Nancy Fritts-Saavedra, P.O. Box 423, Grapeland, TX (US) 75844-0423

( * ) Notice: Subject to any disclaimer, the term of this patent is extended or adjusted under 35 U.S.C. 154(b) by 0 days.

(21) Appl. No.: 11/184,492

(22) Filed: Jul. 19, 2005

(51) Int. Cl.
*E21B 19/00* (2006.01)

(52) U.S. Cl. ..... 254/30

(58) Field of Classification Search ..... 254/30, 254/132, 18
See application file for complete search history.

(56) References Cited

U.S. PATENT DOCUMENTS 871,083 A * 11/1907 Brown ..... 254/18
5,566,924 A * 10/1996 Shirk ..... 254/18
6,527,250 B1 * 3/2003 Tyson ..... 254/30
6,938,881 B1 * 9/2005 Grapes ..... 254/352

* cited by examiner

*Primary Examiner*—Robert C. Watson
(74) *Attorney, Agent, or Firm*—Wong, Cabello, Lutsch, Rutherford & Brucculeri

(57) ABSTRACT

A winch-actuated post puller is disclosed which applies a substantially linear withdrawal force to a post to be removed from the ground. A post gripper is attached to a slider that rides on a vertical shaft. The slider is raised by means of a cable attached to a winch at or near the top of the vertical shaft. In one preferred embodiment, the winch is actuated by a reciprocating lever acting on a ratchet wheel via a pawl.

3 Claims, 3 Drawing Sheets

36
42
48
40
50
34
38
32
30
26
16
10
24
18
28
21
22
20
23
14
12

POST PULLER

BACKGROUND OF THE INVENTION

1. Field of the Invention

This invention relates to devices for removing posts from the ground. More specifically, it relates to hand-operated post pullers.

2. Description of the Related Art

The post pullers of the prior art typically comprise a lever-and-fulcrum mechanism acting directly on the post to be removed. In one commonly used device, a stand is placed next to the post. The top of the stand serves as a fulcrum for a lever attached at its short end to the post and actuated by pressing down by hand on its long end. The mechanical advantage of the lever is used to impart an upward force on the post.

However, for maximum mechanical advantage, the travel of the short end of the lever is small—typically a few inches. This means that the connection to the post must be repeatedly made and unmade as the post is withdrawn from the ground. Moreover, the geometry of the lever arrangement is such that a directly upward force cannot be imparted—the lever moves in an arc. Thus, a sideways force is also imparted to the post which acts to increase friction between the post and the ground. This is undesirable and makes withdrawing the post from the ground more difficult.

What is needed is a post puller which uses the mechanical advantage of a lever while imparting a linear, withdrawal force to the post and having sufficient travel to remove most posts without the need to reattach the device to the post. The present invention solves this problem.

BRIEF SUMMARY OF THE INVENTION

A post puller comprises a winch-and-cable mechanism attached to a sliding post gripper. Winding the winch cable on the drum of the winch raises the post gripper which travels along a vertical shaft supporting the winch thereby pulling the post from the ground. A lever acting on a ratchet wheel is used to rotate the winch drum. The post gripper is designed to engage both conventional wooden posts and metal T-posts.

BRIEF DESCRIPTION OF THE SEVERAL VIEWS OF THE DRAWING(S)

DETAILED DESCRIPTION OF THE INVENTION

Figures 1, 2:
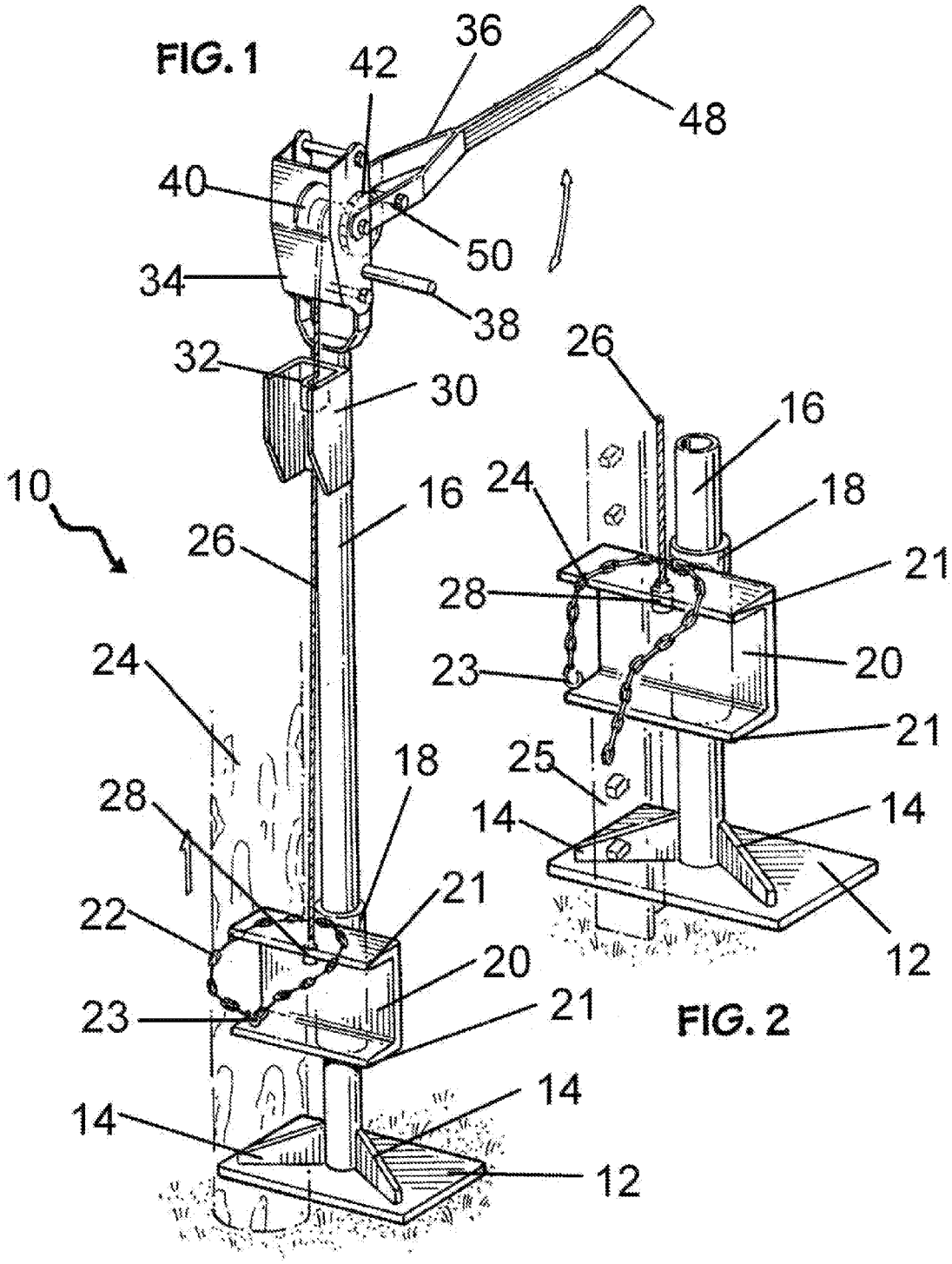
FIG. 1 is a perspective view of one preferred embodiment of the post puller.
FIG. 2 is a perspective view of the lower section of the post puller shown in FIG. 1 positioned on a T-post.
Figure 3:
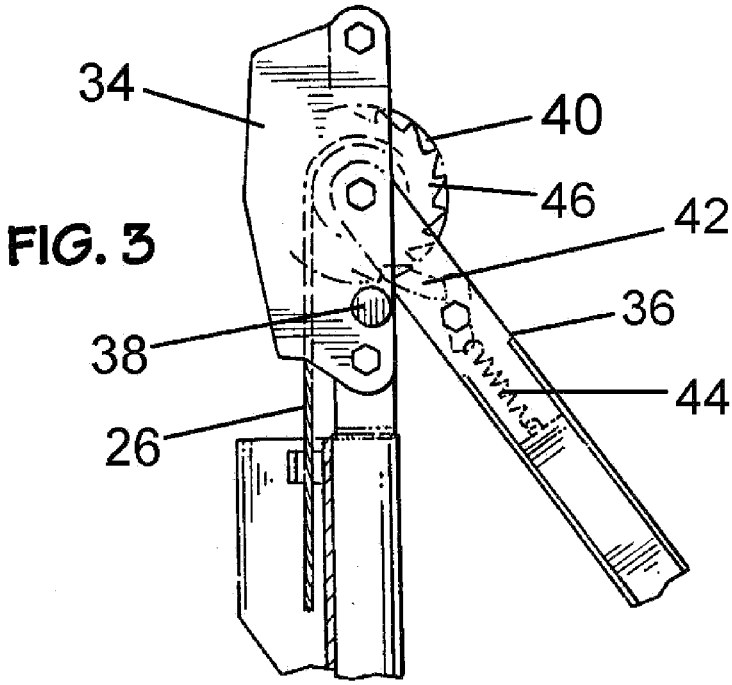
FIG. 3 is a side view of the upper portion of the post puller shown in FIG. 1.
Figure 4:
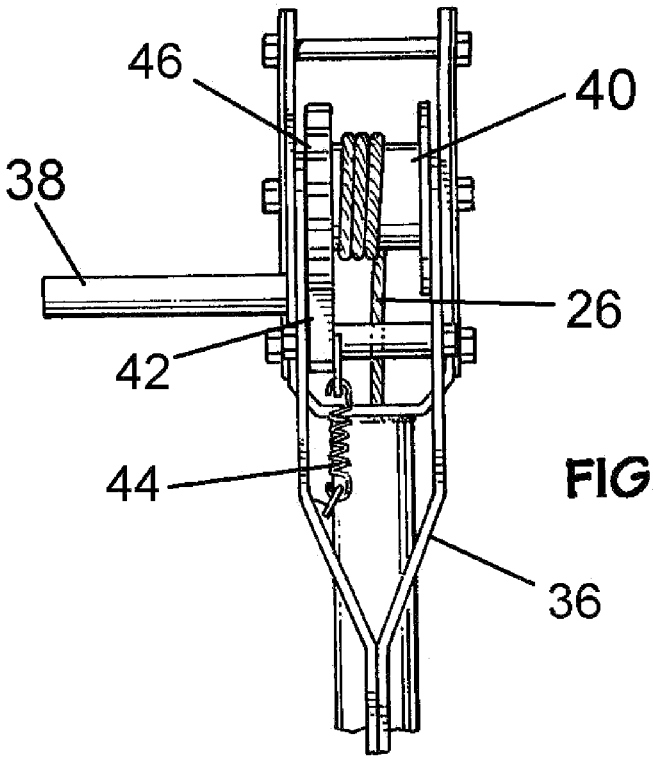
FIG. 4 is a rear view of the upper portion of the post puller shown in FIG. 1.
Figure 5:
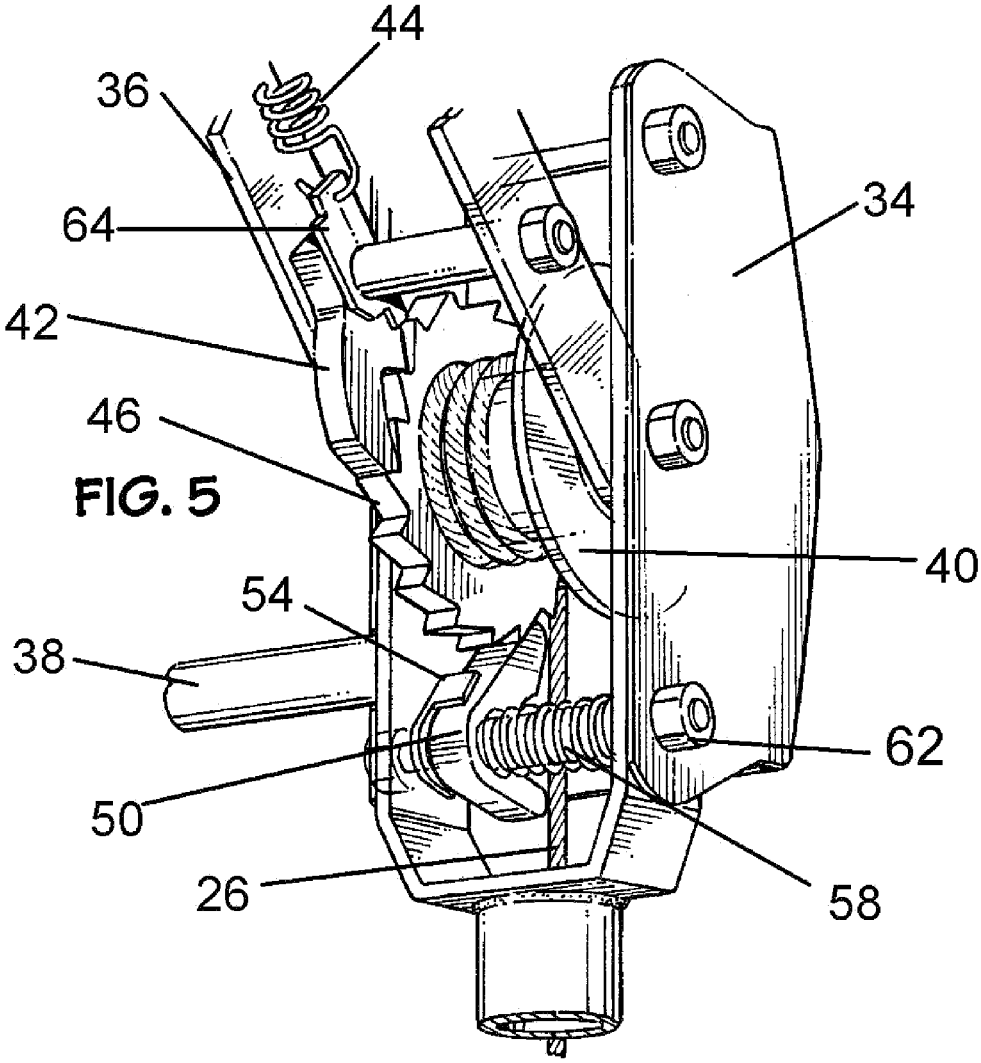
FIG. 5 is an enlarged, perspective view of the winch mechanism of the post puller shown in FIG. 1.
Figure 6:
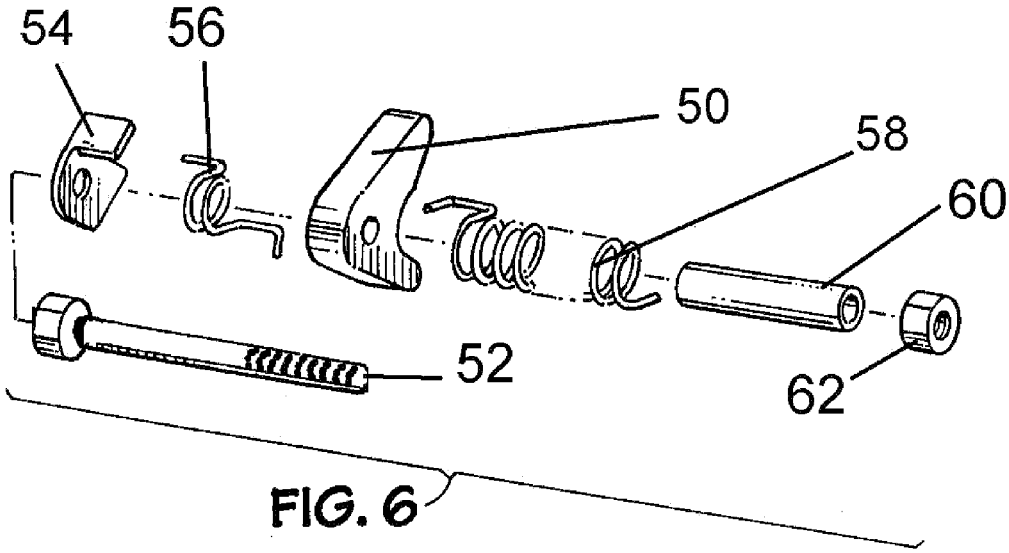
FIG. 6 is an exploded view of the pawl mechanism of the winch shown in FIG. 5.

The invention may best be understood by reference to a particular preferred embodiment illustrated in the drawing figures.

FIG. 1 shows post puller 10 engaged to withdraw wooden post 24 (shown in phantom). FIG. 2 shows the lower portion of post puller 10 positioned to engage a metal T-post 25 (shown in phantom) installed in the ground.

Post puller 10 comprises generally planar base 12 to which is attached generally vertical cylindrical shaft 16. Buttresses or flanges 14 may be used to reinforce the joint between base 12 and shaft 16 and maintain shaft 16 in a generally perpendicular relation to base 12.

Slider 18 fits on shaft 16 in sliding engagement. Post gripper 20, which may comprise a section of U-channel stock, is attached to slider 18. Chain 22 including hook 23 is affixed to the upper surface of post gripper 20 and may be used to secure post gripper 20 to post 24 or T-post 25. As post gripper 20 moves up shaft 16, chain 22 tightens around post 24, 25 biasing it against legs 21. The outer surface of legs 21 may have sharp edges to increase the engagement of gripper 20, particularly with wooden posts 24. The combination of gripper 20, slider 18 and chain 22 may have sufficient weight to unwind cable 26 from winch drum 40 under the influence of gravity when pawls 50 and 42 are released thereby returning slider 18 to the starting position proximate base 12.

Stand-off 30 may be attached to shaft 16 near its upper extreme. Stand-off 30 assists in setting and keeping shaft 16 generally parallel to post 24, 25. Stand-off 30 also prevents the top of post 24, 25 from contacting winch 34 during the withdrawal of the post from the ground. Stand-off 30 may be dimensioned such that its front surface is generally in the same plane as the front surface of post gripper 20.

Winch 34 is mounted to the upper end of shaft 16. Cable 26, which may be galvanized 3/16-inch aircraft cable, extends from winch 34 to post gripper 20 where it may be secured by means of swaged cable attachment fitting 28. Cable guide 32 may be used to ensure the alignment of cable 26 with winch drum 40. In other embodiments, winch 34 may be a strap winch and cable 26 may be replaced with a strap.

Winch 34 is actuated by reciprocating lever 36 which may comprise hand grip 48. Hand hold 38 attached to winch 34 may be provided to assist in positioning post puller 10 against post 24, 25 and to steady the device during operation.

Winch 34 is shown in greater detail in FIGS. 3–6. Winch drum 40 upon which cable 26 is wound is actuated by reciprocating lever 36 acting on ratchet wheel 46 via pawl for communicating motion 42. Pawl 42 is biased for engaging ratchet wheel 46 by pawl spring 44.

Pawl 50 for preventing backward motion is biased for engagement with ratchet wheel 46 by primary spring 58 and secondary spring 56, both of which may be helically wound springs. Pawl 50, pawl release 54, secondary spring 56, primary spring 58 and bushing 60 are coaxially mounted on bolt 52 which is secured to the frame of winch 34 by nut 62.

Plate 64 attached to pawl 42 is configured to contact pawl release 54 at one extreme of travel of reciprocating lever 36 so as to permit a one-notch-at-a-time release of tension from the winch cable 26. Stated another way, at the lower extreme of travel of reciprocating lever 36, plate 64 [or beveled surface of pawl 42?] contacts pawl release 54 which moves pawl 50 out of engagement with ratchet wheel 46. Subsequent upward movement of lever 36 permits a one-notch unwinding of drum 40 whereupon pawl 50 reengages with ratchet wheel 46, preventing further movement of drum 46 in the unwinding direction. Alternating upward and downward movement of lever 36 can therefore be used to release the cable tension on drum 40 one notch at a time in a controlled manner.

In use, pawls 50 and 42 are disengaged from ratchet wheel 46 thereby permitting slider 18 to travel down shaft 16 to the starting position at or near base 12. If necessary, slider 18 may be manually assisted to the starting position. Post puller 10 is then positioned next to a post 24, 25 to be pulled from the ground. Handle 38 may be used to align shaft 16 of post puller 10 with post 24, 25. The front surfaces of both stand-off 30 and post gripper 20 should be in contact with post 24, 25. Chain 22 is wrapped around post 24, 25 and secured with hook 23. It will be appreciated that the post 24, 25 is in contact with post gripper 20 as well as chain 22.

To effect removal of the post from the ground, reciprocating lever 36 is then alternately moved up and down (as illustrated in FIG. 1) to wind cable 26 on drum 40 thereby pulling slider 18 and post gripper 20 up shaft 16. As gripper 20 moves up shaft 16, chain 22 will tighten around post 24, 25 in binding relation since chain 22 is being pulled on only one side of post 24, 25 by gripper 20 and slider 18. Thus, as slider 18 ascends shaft 16, post 24, 25 is pulled from the ground.

As will be appreciated by those skilled in the art, the travel of slider 18 is determined by the length of shaft 16. For most posts in most soils, a travel of about 40 inches has been found to be sufficient to effect removal or at least withdraw the post to an extent permitting complete removal by hand. If necessary, however, the tension on cable 26 may be slackened by disengaging pawls 42 and 50 from ratchet wheel 46, chain 22 loosened or removed from post 24, 25 and slider 18 repositioned near base 12 to repeat the process on the same post, thereby increasing the total travel.

For convenience in operation, it has been found that the length of shaft 16 which results in placement of reciprocating lever 36 at about shoulder height of the operator is particularly preferred.

Although the invention has been described in detail with reference to certain preferred embodiments, variations and modifications exist within the scope and spirit of the invention as described and defined in the following claims.

What is claimed is:

1. A post puller comprising:

a base for supporting the post puller on the ground;

a substantially vertical shaft connected at a first end to the base;

a post gripper in sliding engagement with the shaft;

a winch mounted on a second end of the vertical shaft;

a cable attached to the post gripper and the winch such that winding the cable on the winch pulls the post gripper up the vertical shaft; and, a stand-off proximate the second end of the vertical shaft for preventing contact between the winch and a post being pulled from the ground by the post puller.

2. A post puller comprising:

a base for supporting the post puller on the ground;

a substantially vertical shaft connected at a first end to the base;

a post gripper comprising a section of U-channel steel in sliding engagement with the shaft;

a winch mounted on a second end of the vertical shaft; and, a cable attached to the post gripper and the winch such that winding the cable on the winch pulls the post gripper up the vertical shaft.

3. A post puller comprising:

a base for supporting the post puller on the ground;

a substantially vertical shaft connected at a first end to the base;

a post gripper in sliding engagement with the shaft;

a winch mounted on a second end of the vertical shaft;

a cable attached to the post gripper and the winch such that winding the cable on the winch pulls the post gripper up the vertical shaft; and, a cable guide on the vertical shaft for maintaining alignment of the cable with the winch.

* * * * *